United States Patent [19]

Braga et al.

[11] 4,357,812

[45] Nov. 9, 1982

[54] TUB HAVING A DEBRIS COLLECTOR FOR AN AUTOMATIC WASHER

[75] Inventors: Albert T. Braga, Lincoln Township, Berrien County; William Ohmann, St. Joseph Township, Berrien County, both of Mich.

[73] Assignee: Whirlpool Corporation, Benton Harbor, Mich.

[21] Appl. No.: 178,386

[22] Filed: Aug. 15, 1980

[51] Int. Cl.[3] ..... D06F 13/02; D06F 39/06

[52] U.S. Cl. ..... 68/18 D; 210/305; 210/360.1

[58] Field of Search ..... 68/18 D, 208, 23.4; 210/305, 306, 307, 360.1, 532.1

[56] References Cited

U.S. PATENT DOCUMENTS

| | | | |
|---|---|---|---|
| 2,056,887 | 10/1936 | Pecker | 210/307 X |
| 2,900,812 | 8/1959 | Smith | 68/208 X |
| 3,138,946 | 6/1964 | Amthor, Jr. et al. | 68/208 X |
| 3,216,224 | 11/1965 | Poole | 68/23.4 |
| 3,246,837 | 4/1966 | Douglas | 68/23.4 X |
| 3,400,074 | 9/1968 | Grenci | 210/360.1 X |
| 4,127,735 | 2/1979 | Bright et al. | 68/18 D |

*Primary Examiner*—Philip R. Coe

*Attorney, Agent, or Firm*—Hill, Van Santen, Steadman, Chiara & Simpson

[57] ABSTRACT

An automatic washing machine of the vertical axis type is provided with an annular channel in the bottom of the tub to collect debris and sediment particles and with an annular baffle to prevent the collected particles from being deposited in the washed articles during the direct-into-spin portion of the wash cycle.

7 Claims, 5 Drawing Figures

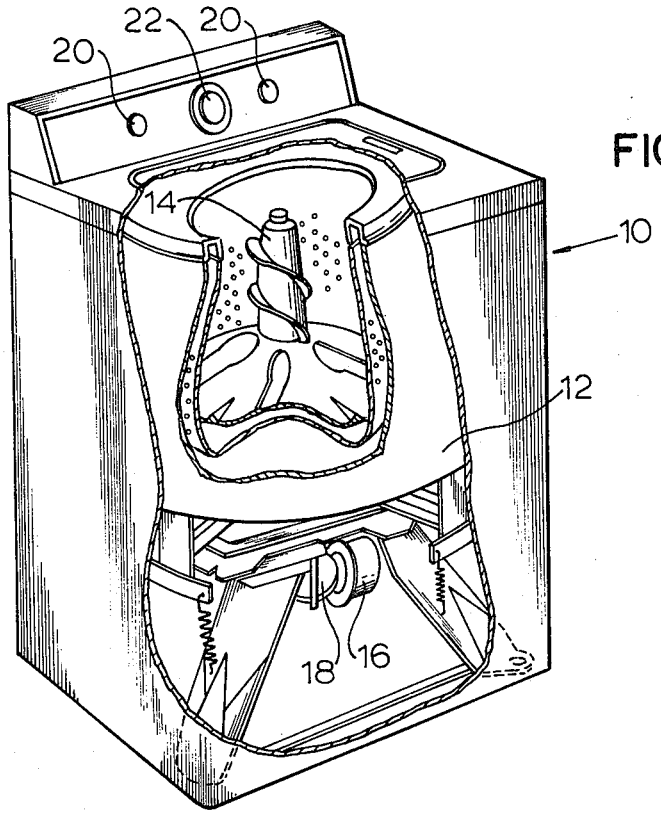
FIG. 1
FIG. 2
(PRIOR ART)
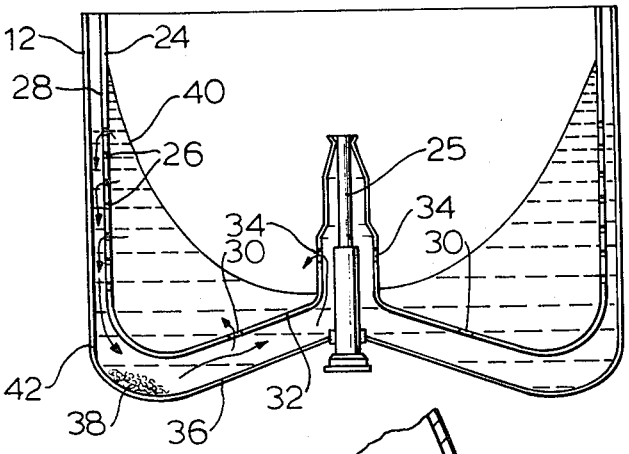
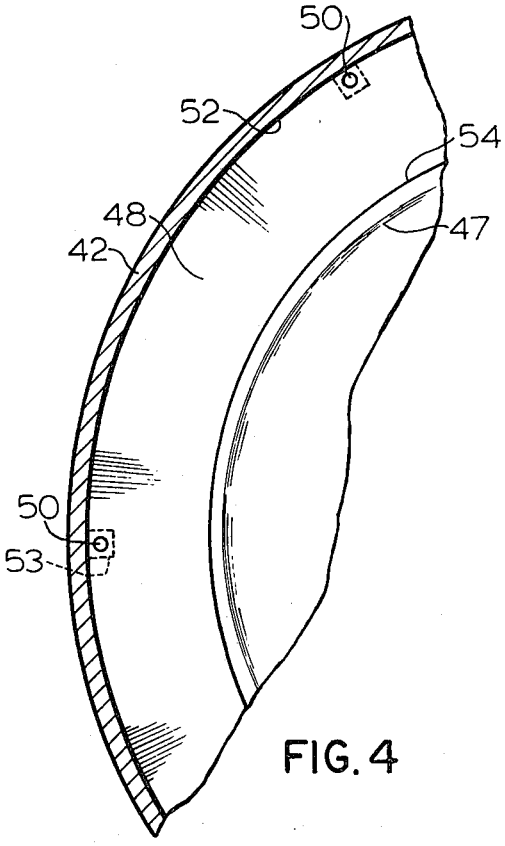
FIG. 4
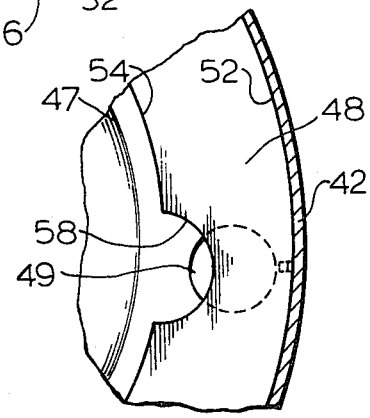
FIG. 5

TUB HAVING A DEBRIS COLLECTOR FOR AN AUTOMATIC WASHER

BACKGROUND OF THE INVENTION

1. Field of the Invention

This invention relates to automatic washing machines of the vertical axis type.

2. Description of the Prior Art

In the agitation and scrubbing of clothing articles in a domestic washing machine, sediment and debris particles removed from the clothing articles generally have a density greater than the washing fluid and gravitate to the bottom of the washing basket, through the holes therein, and into the washing tub.

After the agitation cycle, the motor in the washing machine is reversed, causing the drain pump to begin to drain the basket and tub of washing liquid and at the same time causing the transmission to begin to drive the basket in rotation for the spin cycle. This is called a direct-into-spin system because the basket begins its spin cycle before the washing liquid has been drained therefrom.

Such a direct-into-spin system can cause a pressure gradient forcing the washing liquid from the tub through openings in the bottom of the basket and outwardly through the clothes, thus distributing sand and dirt particles that have settled within the tub on the clean clothes. This problem is described in U.S. Pat. No. 4,137,735 and proposed to be solved by moving a single row of openings in the bottom wall of the basket sufficiently far from the vertical axis of the agitator so that the pressure gradient will be too low to allow flow from the tub through the holes during the direct-into-spin cycle.

U.S. Pat. No. 3,246,837 discloses an annular channel connected beneath drip holes in the generally imperforate bottom basket to collect debris and distribute the debris centrifugally into the tub when the machine moves into the direct-into-spin portion of the cycle.

U.S. Pat. No. 2,900,812 discloses a sediment ring in the tub bottom, and a baffle covering a sector of the tub bottom to scour debris moved by vortex action during the agitation cycle toward the center of the tub bottom.

SUMMARY OF THE INVENTION

The present invention relates to an automatic washing machine of a vertical axis agitator type having a basket containing a plurality of openings in the basket bottom wall through which washing liquid passes during the washing cycle. During the direct-into-spin portion of the cycle, the pressure differential created causes a toroidal or vortex flow within the tub forcing the wash liquid (including the sand and dirt particles which have accumulated in the tub) inwardly through the basket openings and depositing the sand and dirt particles on the clothes which are being forced against the basket side wall.

In accordance with the present invention, a quiet area in the tub bottom is provided which is not affected by the vortex flow. Specifically, the tub is formed around its outer bottom wall with a sump or channel portion which collects the debris and sediment particles during the agitate portion of the washing cycle. An annular baffle is attached to the side wall of the tub and extends over the sump area in the tub to isolate the quiet area.

During the direct-into-spin portion of the cycle, when the vortex is generated by the pressure differential established by the spinning of the basket, the baffle deflects the flow past the sump area, thus preventing the flow of the debris particles inwardly with the liquid through the openings in the bottom of the basket. As the water level within the tub is decreased by the drain pump, the vortex flow is broken, and the flow becomes completely rotary to flush the sump area clean. A drain opening is provided in the sump portion which communicates with the drain pump such that the washing liquid drains from the tub through the sump portion.

DESCRIPTION OF THE DRAWINGS

FIG. 1 is a perspective view of a washing machine with a partial cut-away to show the mechanical workings within the washing machine including a tub with a vertical agitator.

FIG. 2 is a diagrammatic cross-sectional view of the washing machine tub and the basket showing the pressure gradient of the washing fluid within the spin basket during the washer spin cycle.

FIG. 4 is a partial sectional view taken along lines IV—IV of FIG. 3.

FIG. 5 is a partial sectional view taken along lines V—V of FIG. 3.

DESCRIPTION OF THE PREFERRED EMBODIMENTS

Figure 3:
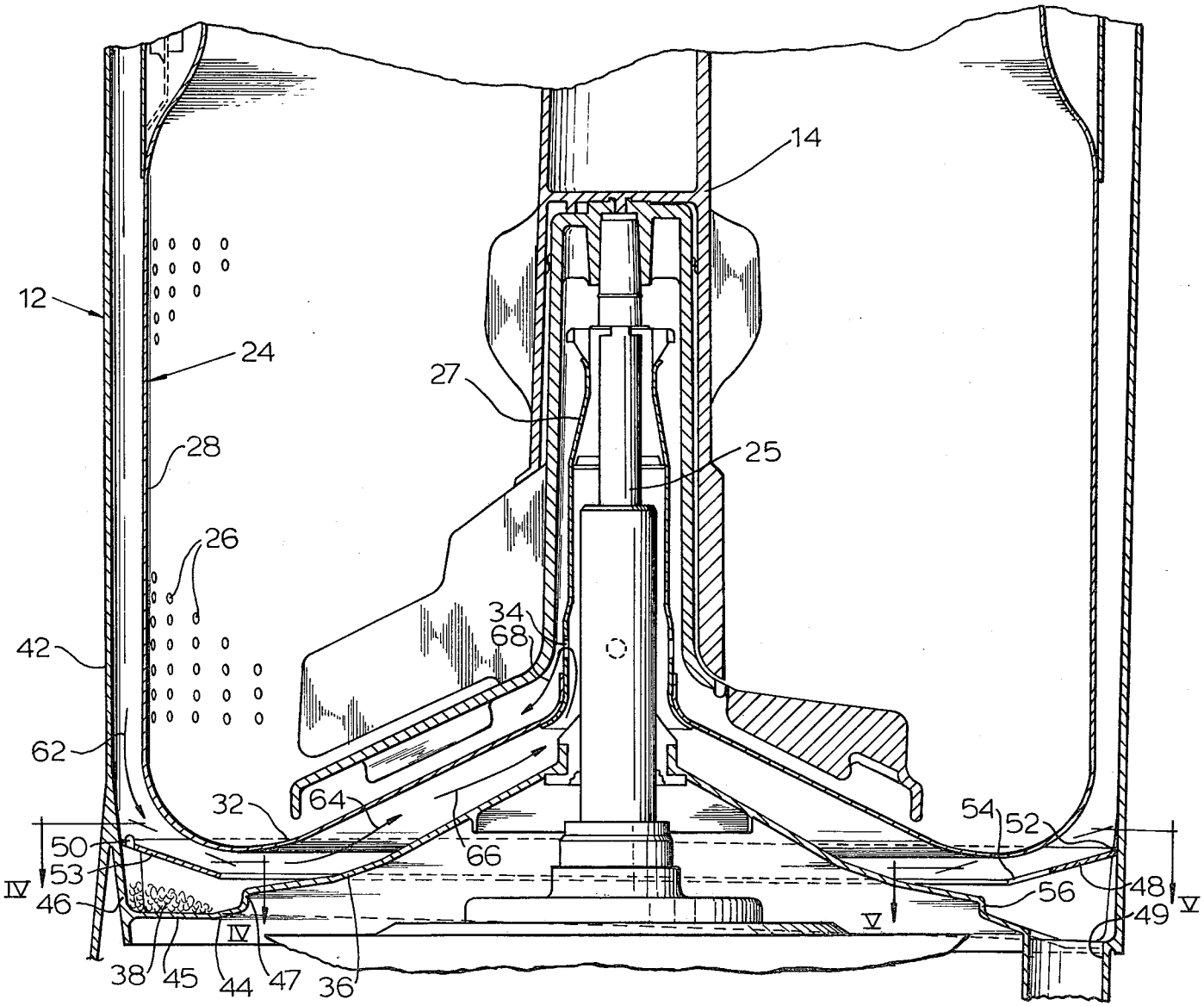
FIG. 3 is a side cross-sectional view of the tub, basket and agitator of the washing machine shown in FIG. 1.

In FIG. 1 a washing machine is generally shown at 10 as having a tub 12 and a vertical agitator 14 therein, a water supply (not shown), a power supply (not shown), an electrically driven motor 16 operably connected via a transmission 18 to the agitator 14, and controls 20 including a pre-settable sequential control means 22 for use in selectively operating the washing machine 10 through a programmed sequence of washing, rinsing and extracting steps.

FIG. 2 shows a diagrammatic cross-sectional view of the interior of the tub 12 of the washing machine 10 which is concentrically mounted about a spin tube 25. Also, a perforate washing basket 24 is concentrically mounted about spin tube 25 at a top portion of a center post 27 inwardly of the tub 12. Openings 26 are formed in a side wall 28 of the basket 24 and a circular row of openings 30 is formed in a bottom 32 of the basket 24. The center post 27 has openings 34 therein which communicate with the space between the bottom wall 32 of the basket 24 and a bottom wall 36 of the tub 12.

During the agitate portion of the wash cycle, sediment and debris particles 38 are loosened and removed from clothing articles within the basket 12 and having a density greater than the washing fluid, the debris and sediment particles 38 collect in the bottom of the tub 12 around the outer edge of the bottom wall 36 and the lower portion of a side wall 42 of tub 12.

As seen in FIG. 2, when the washing cycle progresses into a direct-into-spin cycle, a top surface 40 of the washing liquid forms a parabolic shape due to centrifugal force caused by the spinning of the liquid in the washing basket 24. A pressure gradient results wherein the pressure at the bottom of the tub 12 is greatest at the side wall 42 and lowest adjacent the center post 27. This pressure difference or gradient causes a flow of water radially inwardly along the bottom wall 36 of the tub 12 resulting in a return flow into the basket 24 through openings 30 and 34. In a tub constructed as shown in FIG. 2, this flow would pick up the debris and sediment particles 38 which had collected in the bottom of the tub 12 and would deposit the particles 38 on clothes carried within the basket 24.

In accordance with the present invention and as shown in FIG. 3, the perforate washing basket 24 is provided with openings 26 in the side wall 28 and is carried about the spin tube 25 within the tub 12. An annular channel or sump portion 44 is formed in the bottom wall 36 of the tub 12 at the outer circumference thereof adjacent the side wall 42.

The annular channel 44 has a bottom wall 45 bounded by an outer circumferential wall 46 which is formed by a lower portion of the side wall 42 of the tub 12 and an inner circumferential wall 47 which joins the bottom wall 36 of the tub 12. The debris and sediment particles 38 will collect in the annular channel 44 during the agitation portion of the washing cycle. A drain opening 49 connects the annular channel 44 to a drain pump (not shown).

An annular baffle 48 is provided above the channel 44 and abuts the side wall 42 of the tub 12 as best seen in FIGS. 3 and 4. A plurality of alignment studs 50 extend through openings 51 in baffle 48 to align and support the baffle 48 adjacent the side wall 42. The studs 50 may be deformed to secure the baffle against a shoulder 53 on studs 50 or may be heat welded to the side arm 42.

The annular baffle 48 has an outer circumference 52 adjacent the side wall 42 of the tub and an inner circumference 54 sized to be slightly larger than the inner circumferential wall 47 of the channel 44. Thus the baffle 48 only partially covers the channel 44. When the baffle 48 is in place within the tub 12 it will be oriented so as to slope downwardly from the outer circumference 52 to the inner circumference 54.

As best seen in FIG. 5, a semi-circular notch 58 is provided in the baffle 48 immediately above the drain opening 49. The notch 58 aids in the drainage of the wash fluid from the tub 12 during the spin portion of the cycle.

During the agitate portion of the wash cycle, debris and sediment particles 38 are loosened from clothing being washed and such particles having a density greater than that of the wash fluid, fall downwardly through the wash fluid to rest at the bottom of the tub 12. As the particles 38 fall downwardly between the side wall 42 of the tub 12 and the side wall 28 of the basket 24, they fall towards the baffle 48. Since the baffle 48 slopes downwardly and the interior circumference 54 of the baffle 48 is larger than the inner circumferential wall 47 of the channel 56, the particles 38 slide down the baffle 48 and fall into the channel 44 and are deposited on the bottom wall 45 of the channel 44. Particles also slide down bottom wall 36 of the tub 12 into the channel 44.

When the control means 22 advances the washing machine into the direct-into-spin portion of the washing cycle, the surface of the wash liquid 40 assumes a parabolic shape similar to that shown in FIG. 2 causing a toroidal or vortex flow downwardly between the side wall 42 of the tub 12 and the side wall 28 of the basket 24 depicted by arrow 62. The water continues to flow toward the area of low pressure near the center of the basket 24 as depicted by arrows 64, 66. The wash fluid re-enters into the basket through opening 34 in the agitator post 25 as depicted by arrow 68. The baffle 48 directs the flow of water away from the channel 44 and thus prevents the debris and sediment particles 38 from being swept into the toroidal flow and thus being redeposited on the clothing within the basket 24.

As the water level within the tub is decreased due to the drainage of the wash fluid through the drain opening 46, the toroidal flow is broken. Urged by the spinning basket 24 the flow of wash fluid becomes completely rotary causing the sump area 44 to be cleaned of the debris and sediment particles 38 which flow with the fluid through the drain opening 46.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In an automatic clothes washing machine of the vertical axis type having a generally axially symmetric imperforate tub with a side wall and a bottom wall for containing wash liquid; a basket rotatably mounted about said axis within said tub; and a debris collection means; said collection means comprising:

means forming an annular channel in said bottom wall of said tub, said channel being at least partially covered by an annular baffle, said annular baffle having an outer circumference mounted on said side wall of said tub and said baffle slopes downwardly from its outer circumference to an inner circumference, whereby collected particles are prevented from being re-deposited on laundered clothes.

2. In an automatic clothes washing machine of the vertical axis type having a generally axially symmetric imperforate tub with a side wall and a bottom wall for containing wash liquid; a basket rotatably mounted about said axis within said tub; and a debris collection means; said collection means comprising:

means forming an annular channel in said bottom wall of said tub wherein said annular channel is disposed at the outer diameter of said bottom wall, said channel being at least partially covered by an annular baffle wherein said annular baffle has an outer circumference mounted on said side wall of said tub, and wherein said annular baffle slopes downwardly from its outer circumference to an inner circumference, whereby collected particles are prevented from being redeposited on laundered clothes.

3. The washing machine of claim 2, wherein said annular baffle inner circumference is larger than an inner circumference of said annular channel.

4. The washing machine of claim 2, wherein said channel has therein a drain opening for removal of said wash liquid.

5. An automatic washing machine comprising:

a tub, a spin basket in said tub having a plurality of openings in the basket bottom wall through which washing liquid passes during the washing cycle, a vertical axis agitator in said spin basket, sequential control means for operating said spin basket and said vertical axis agitator through a series of washing and drying steps including a direct-into-spin portion of the cycle wherein the pressure differential created within said tub causes a toroidal flow forcing the wash liquid inwardly through the basket openings, means forming a quiet area in the tub bottom not affected by the toroidal flow, said quiet area formed by a sump-like channel in the outer portion of said bottom wall of the tub for collecting debris and sediment particles during the agitate portion of the washing cycle, and an annular baffle attached to the side wall of the tub and extending over the channel in the tub to isolate the quiet area, whereby when the toroidal flow is generated by the pressure differential established by the spinning of the basket, the baffle deflects the flow past the sump-like channel portion to prevent the flow of the debris particles inwardly with the liquid through the openings in the bottom of the basket.

6. An automatic washing machine as defined in claim 5, and being further characterized by said sump-like channel portion having a drain opening formed in the bottom thereof, and a drain pump communicating with said drain opening so that washing liquid drains from the tub through the sump-like channel portion, whereby as the water level within the tub is decreased by the drain pump, the vortex flow is broken and flow will become completely rotary to flush the sump-like channel clean.

7. An automatic washing machine comprising:

a tub;

a clothes washing basket having a circumferential side wall and a bottom wall within said tub, said basket having a plurality of openings in said side wall and said bottom wall through which washing liquid passes;

a vertical axis agitator in said basket;

sequential control means for operating said basket and said agitator through a series of washing and drying steps including a direct-into-spin portion wherein said basket causes a toroidal flow forcing the wash liquid inwardly through said bottom wall openings and outwardly through said side wall openings;

channel means forming a quiet area in said tub bottom not effected by the toroidal flow, said quiet area formed by a sump-like channel in the outer portion of said bottom wall of the tub for collecting debris and sediment particles during an agitate portion of the washing cycle; and an annular baffle attached to the side wall of the tub and extending over the channel in the tub bottom to isolate the quiet area, said annular baffle having an inner circumference greater than an inner circumference of said channel, whereby when the toroidal flow is generated by the pressure differential established by the spinning of the basket, the baffle deflects flow past the sump-like channel portions to prevent the flow of the debris inwardly with the liquid through the openings in the bottom of the basket.

* * * * *